US005310068A

United States Patent [19]

Saghri

[11] Patent Number: 5,310,068

[45] Date of Patent: May 10, 1994

[54] DISPOSABLE COLLAPSIBLE BEVERAGE BOTTLE

[76] Inventor: Abdolhamid Saghri, 8207 Stonetrail Dr., Bethesda, Md. 20817

[21] Appl. No.: 40,363

[22] Filed: Mar. 30, 1993

Related U.S. Application Data

[63] Continuation-in-part of Ser. No. 766,781, Sep. 27, 1991, abandoned.

[51] Int. Cl.[5] ..... B65D 1/02; B65D 23/00

[52] U.S. Cl. ..... 215/100 R; 215/1 C; 215/12.1; 220/666

[58] Field of Search ..... 215/1 C, 12.1, 100 R; 220/666, 907, 669, 737; 222/109, 105, 107, 95; 383/120, 2

[56] References Cited

U.S. PATENT DOCUMENTS

| | | | |
|---|---|---|---|
| 1,787,061 | 12/1930 | Wolf | 222/105 |
| 2,129,119 | 9/1938 | Davis | 222/105 |
| 2,899,110 | 8/1959 | Parker | 215/1 C |
| 3,231,139 | 1/1966 | Bouet | 222/105 X |
| 3,434,589 | 3/1969 | Valtri et al. | 206/218 |
| 3,872,994 | 3/1975 | Hyde | 220/906 X |
| 3,873,003 | 3/1975 | Seiferth et al. | 222/105 X |
| 3,918,603 | 11/1975 | Hatada | 220/906 X |
| 3,939,887 | 2/1976 | Scarnato | 383/120 X |
| 3,996,953 | 12/1976 | Scragg | 222/104 X |
| 4,095,728 | 6/1978 | Chlystun | 222/529 |
| 4,153,172 | 5/1979 | Bialobrzeski | 220/666 X |
| 4,456,134 | 6/1984 | Cooper | 215/12.1 |
| 4,773,458 | 9/1988 | Touzani | 215/1 CX |
| 4,775,564 | 10/1988 | Shriver et al. | 215/1 CX |

FOREIGN PATENT DOCUMENTS

| | | | |
|---|---|---|---|
| 1271144 | 7/1990 | Canada | 220/666 |
| 1288915 | 2/1962 | France | 222/95 |
| 2504095 | 10/1981 | France | 220/666 |
| WO8805014 | 7/1988 | PCT Int'l Appl. | 220/666 |
| WO8807963 | 10/1988 | PCT Int'l Appl. | 222/105 |
| WO9008698 | 8/1990 | PCT Int'l Appl. | 220/666 |
| 457256 | 11/1936 | United Kingdom | 222/104 |
| 2208113 | 3/1989 | United Kingdom | 222/95 |

*Primary Examiner*—Sue A. Weaver

*Attorney, Agent, or Firm*—Cushman, Darby & Cushman

[57] ABSTRACT

A disposable collapsible beverage bottle is disclosed which includes a plurality of flexible straps extending along the bottle's exterior from a collar surrounding the neck of the bottle to a ratcheting arrangement at the bottom of the bottle. When the ratcheting arrangement is actuated, the straps are shortened causing the bottle to collapse. In this way, the volume of air in the bottle is controlled.

16 Claims, 6 Drawing Sheets

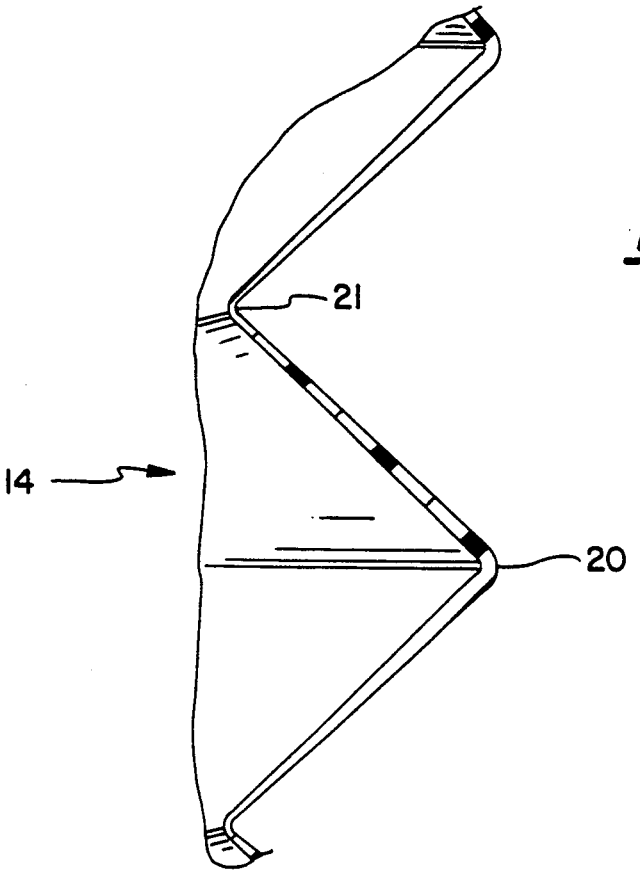
FIG. 2
FIG. 3
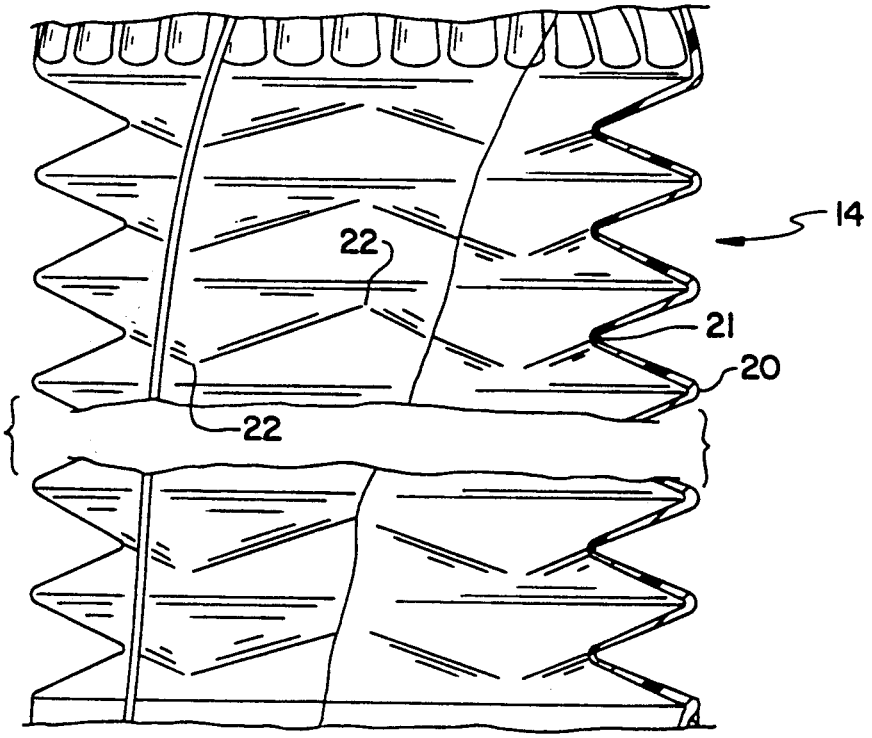

DISPOSABLE COLLAPSIBLE BEVERAGE BOTTLE

BACKGROUND 0F THE INVENTION

The present application is a continuation-in-part application of U.S. application Ser. No. 07/766,781 filed Sep. 27, 1991, now abandoned.

The present invention relates to a collapsible container, and in particular to a disposable collapsible bottle especially suited for carbonated beverages.

Plastic bottles are conventionally used for storing beverages, such as soft drinks and sodas. For stability purposes, known plastic bottles usually either have a cup attached to the base of the bottle, or they stand on molded feet, or pedestals, formed on the base.

Plastic bottles also usually employ removable caps which are effective in sealing the bottle's contents. However, because all of the carbonated beverage in a bottle often is not dispensed at one time, a bottle frequently is resealed with a higher air-to-beverage ratio than before. Consequently, the beverage's carbonation is diminished as a direct result of its escape into the increased volume of air within the bottle. A loss of carbonation leaves the beverage less appetizing to the consumer.

The beverage industry produces plastic bottles in extremely large quantities. Therefore, they must be inexpensive to manufacture and easily stored in a minimum amount of space. Storage space also is a concern for the consumer. Moreover, since containers are marketed to the public in vast quantities, they must be either ecologically disposable or easily recyclable.

A need therefore exists for an improved plastic bottle which satisfies each of these criteria while providing the capability for sustaining a high carbonation level in the beverage.

SUMMARY OF THE INVENTION

The present invention satisfies the foregoing needs. More particularly, the improved collapsible bottle allows a consumer to easily maintain the trapped air volume in a beverage container substantially constant as the bottle is emptied, thereby effectively eliminating the loss of carbonation in the beverage. Furthermore, the bottle may be economically produced and efficiently stored by both the manufacturer and the consumer.

Carbonation depletion significantly impacts the consumer's enjoyment of a beverage. However, carbonation in the beverage can be maintained by controlling the amount of air in the sealed bottle. This can be achieved in various ways. One known way of doing so is through the use of a collapsible bottle. With this technique, the total volume of the bottle is reduced as the beverage is consumed, thereby maintaining substantially constant the amount of air in the container.

A unique feature of the present invention is an improved arrangement for causing a collapsible bottle to be compressed to reduce its volume. This feature is incorporated in respective embodiments of the invention used with the two basic types of plastic beverage containers currently on the market, viz., plastic bottles having a cup secured to the bottom of the bottle and those having molded feet or pedestals on the bottom which keep the bottle upright and stable.

In each embodiment of the invention, a plurality of straps extend lengthwise along the bottle's exterior. The straps are attached to a collar positioned around the neck of the bottle and are secured to a ratcheted winding mechanism at the bottom of the bottle. For bottles with a cup as the base, the rotatable member of the winding mechanism is the cup itself. For pedestal-type bottles, a rotating knob, preferably provided with an easily accessible finger grip, is provided centrally of the pedestals at the bottom of the container. If either the cup or the knob is rotated at a time when pressure within the bottle is relieved, the straps are wound around a stem or spool, thus effectively shortening the length of the straps between the top and bottom of the bottle.

The wall of the central portion of the bottle is pleated in an accordion or bellows-type configuration. Consequently, when the straps are shortened, the bottle collapses and becomes shorter. The consumer rotates the knob or cup until the bottle is short enough to bring the level of the remaining beverage close to the top of the bottle in its neck region. In this way, when the cap reseals the container, the volume of air in the bottle is controlled, whereby the loss of carbonation is substantially reduced.

A further feature of the invention is that the pleats of the central portion of the bottle are dimensioned and configured in such a way as to permit the bottle to smoothly and uniformly collapse as compression forces are exerted on the central portion when the strap lengths are shortened.

In addition to controlling carbonation loss, the present invention is one which can be inexpensively manufactured and is easily usable by a broad range of consumers. Furthermore, in a compressed state, a plastic bottle requires less storage room, and because of its reduced volume, it is more readily ecologically disposed of or recycled.

BRIEF DESCRIPTION OF THE DRAWINGS

The invention now will be described in greater detail with reference to the accompanying drawings wherein:

FIG. 2 is an enlarged view of a portion of the bottle shown in FIG. 1;

FIG. 3 is a fragmented view of a portion of the bottle shown in FIG. 1, the bottle being illustrated in a partially collapsed condition;

DETAILED DESCRIPTION OF THE INVENTION

Figure 1:
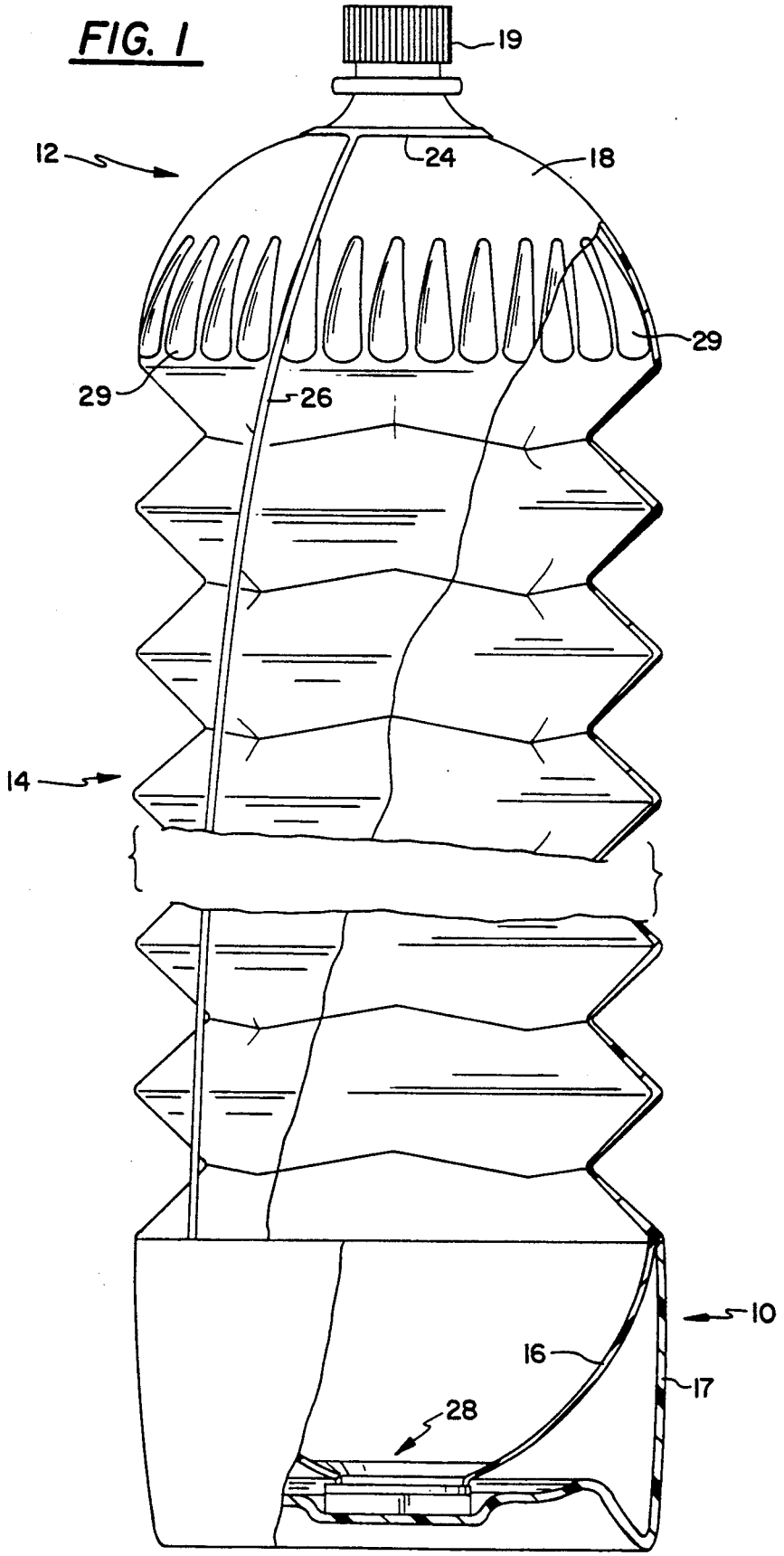
FIG. 1 is a fragmented side elevational view, partially in section, of a first embodiment of a disposable collapsible bottle according to the present invention.

FIG. 1 illustrates a first embodiment of the invention. More particularly, a plastic bottle is shown, the bottle comprising a base portion 10, a top portion 12 and a central portion 14 joining the base and the top.

The base portion 10 comprises a molded bottom surface 16 generally is hemispherical in shape. A plastic cup 17 surrounds surface 16. The underside of cup 17 provides a resting surface for the bottle.

The top portion 12 of the bottle consists of conventional neck and cap sections 18 and 19, respectively.

The central portion 14 joining the base 10 and top 12 is a pleated plastic section integrally joined with portions 10 and 12. For convenience of illustration, only four full peripheral pleats are shown. It will be understood, however, that in practice, additional pleats are contemplated. For example, a bottle of two liter volume typically would include 9–10 peripheral pleats.

Details of the peripheral pleats can be appreciated by reference to FIGS. 2 and 3. More particularly, the pleats are formed by central portion 14 being provided with fold lines spaced substantially equally along its wall. Consequently, the lengths of the walls between adjacent fold lines are uniform. Adjacent fold lines are arranged so that they alternately fold inwardly toward the longitudinal axis of the bottle and outwardly away from the bottle's axis. As a result, portion 14 folds in accordion-like fashion along its periphery.

The outer fold lines 20 have a wall thickness greater than the thickness of the inner fold lines 21. While the outer fold lines 20 define parallel planes which are normal to the longitudinal axis of the bottle, the inner fold lines are folded at radially spaced intervals. The latter folds alternately are in an opposite sense relative to the direction of the bottle's longitudinal axis. As a result, the walls of central portion 14 also are interiorly pleated radially of the longitudinal axis of the bottle. These pleats generally are indicated as 22 in FIG. 3.

As a result of the different wall thicknesses at fold lines 20 and 21, and the provision of radially oriented pleats 22, as the bottle collapses, the folding of the central portion occurs smoothly and uniformly along the length of portion 14 with the interior folds 21 nesting with adjacent folds of corresponding radial orientation. This can be appreciated from the FIG. 3 illustration.

The present invention provides means for permitting the bottle to be collapsed from a fully expanded condition when pressure within the bottle is relieved and force is provided to the bottle longitudinally of its central axis. More particularly, a circular plastic collar 24 rests on the neck 18 of the bottle (FIG. 1). This is be accomplished by passing collar 24 over the cap 19. A plurality of flexible plastic straps 26, integrally formed with the collar 24, and located at radially spaced intervals around the collar, extend downwardly along the surface of the bottle to a ratcheting arrangement 28 at the bottom of the bottle. The arrangement 28 will be described in greater detail hereinafter. However, for present purposes, it is sufficient to describe the arrangement as one in which straps 26 are secured to the ratcheting arrangement in such a manner that when cup 17 is rotated relative to the stationary bottom surface 16, the lower ends of straps 26 are wrapped around a stem or spool, thereby shortening the length of the straps. The consequence of this is that force is applied to the bottle and the central portion 14 is compressed, thereby reducing the bottle's volume.

To prevent the collar 24 from rotating relative to neck 18 during the shortening of straps 26, the neck 18 is provided with a plurality of radially displaced depressions 29 which receive the straps to arrest them against applying forces to the collar which would cause the collar to rotate.

Figure 10:
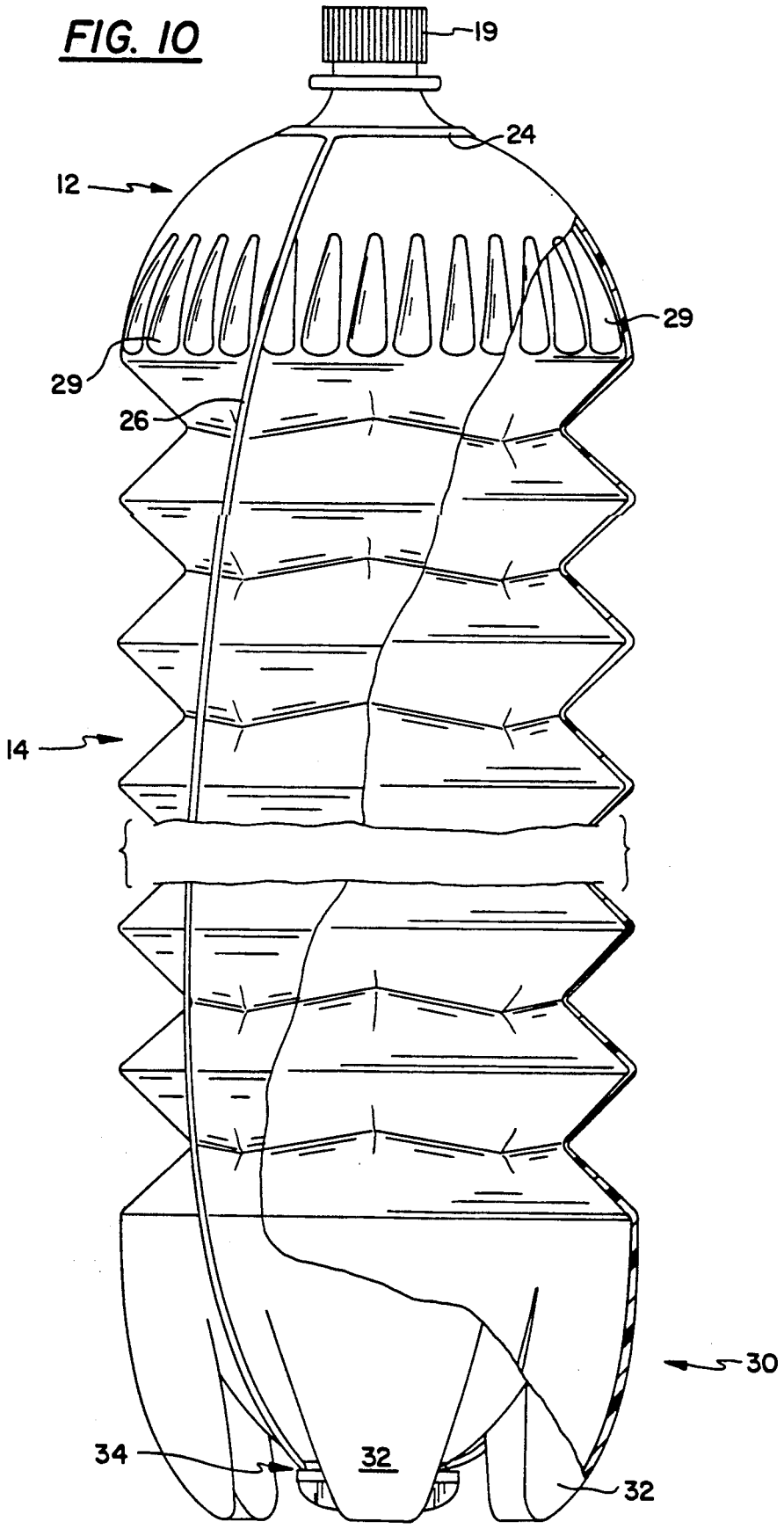
FIG. 10 is a side elevational view, partially in section, of a second embodiment of the invention.

The second embodiment of the invention is shown in FIG. 10. For purposes of description, those portions of the invention shown in FIG. 10 which are common to the FIG. 1 embodiment are identified by the same reference numerals.

The arrangement of FIG. 10 differs from that of FIG. 1 in respect of the base portion. More particularly, rather than utilizing a cup at the bottom of the bottle to provide support, the base portion 30 includes a plurality of pedestals 32 which are formed in the bottom of the bottle as it is molded. Such a pedestal arrangement is well known in the art and need not be described further other than to state that for purposes to be described hereinafter, the number of pedestals preferably is an even number, at least 4.

In conventional bottles of the pedestal type, the pedestals surround a recess at the bottom of the bottle. In the present embodiment, a ratcheting arrangement 34 is provided in the recess. As in the case of the FIG. 1 embodiment, the lower ends of flexible straps 26 are joined to the ratcheting arrangement 34, while the upper ends of the straps are integrally joined to collar 24 resting on the neck 18 of the bottle. Accordingly, when the pressure within the bottle is relieved by opening cap 19, the actuation of the ratcheting arrangement 34 causes the lower ends of the straps 26 to be wrapped around a spool, thereby shortening the straps. This produces a compressive force on the bottle which causes central portion 14 to collapse, thereby reducing the height of the bottle and decreasing the volume of its interior.

From the description just provided with respect to embodiments of FIGS. 1 and 10, it can be appreciated that when the bottle contains a carbonated beverage, the volume of air overriding the upper surface of the beverage within the bottle can be maintained substantially constant as the beverage is dispensed. This is accomplished by the selective actuation of the ratcheting arrangements of the respective bottles. Thus, with the cap 19 secured to the bottle after desired compression is achieved, the loss of carbonation from the beverage is substantially reduced. Additionally, reduction in the size of the bottle facilitates its storage. Also, the compressed bottle can be more easily handled for disposal and recycling purposes, thereby promoting ecological considerations.

Details of the ratcheting arrangements for the two embodiments of the invention just described are illustrated in FIGS. 4–9 and 11–13. More particularly, in FIG. 4, the underside of the bottom surface 16 of the first embodiment of the invention is illustrated.

The bottom of surface 16 is provided with an annular projection 36 which is concentric with the major axis of the bottle. Projection 36 is surrounded by an annular array of inclined segments 38 which also project from the bottom surface 16. The projection 36 and segments 38 preferably are integrally formed with surface 16 during the molding of the bottle.

Figure 5:
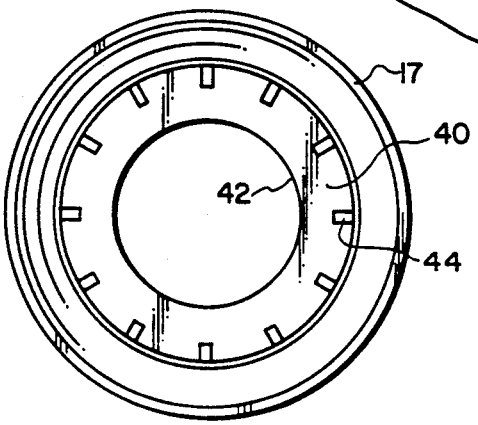
FIG. 5 is a top plan view of another portion of the embodiment shown in FIG. 1.
Figure 6:
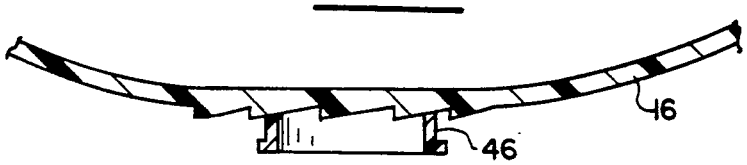
FIG. 6 is a sectional view taken along the line 6—6 of FIG. 4.

FIG. 5 illustrates the remaining portion of the ratcheting arrangement 28 of the FIG. 1 embodiment. More particularly, there is provided within cup 17, a centrally located annular member 40 having a central opening 42 dimensioned to receive the projection 36. Member 40 includes radially spaced projections 44 at its periphery, the number of projections corresponding to the number of segments 38 on the underside of surface 16.

Figure 4:
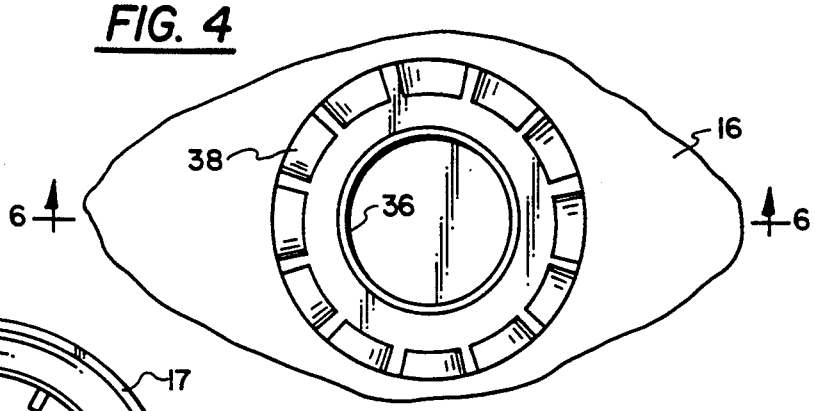
FIG. 4 is a fragmented bottom view of a portion of the embodiment shown in FIG. 1.
Figure 7:
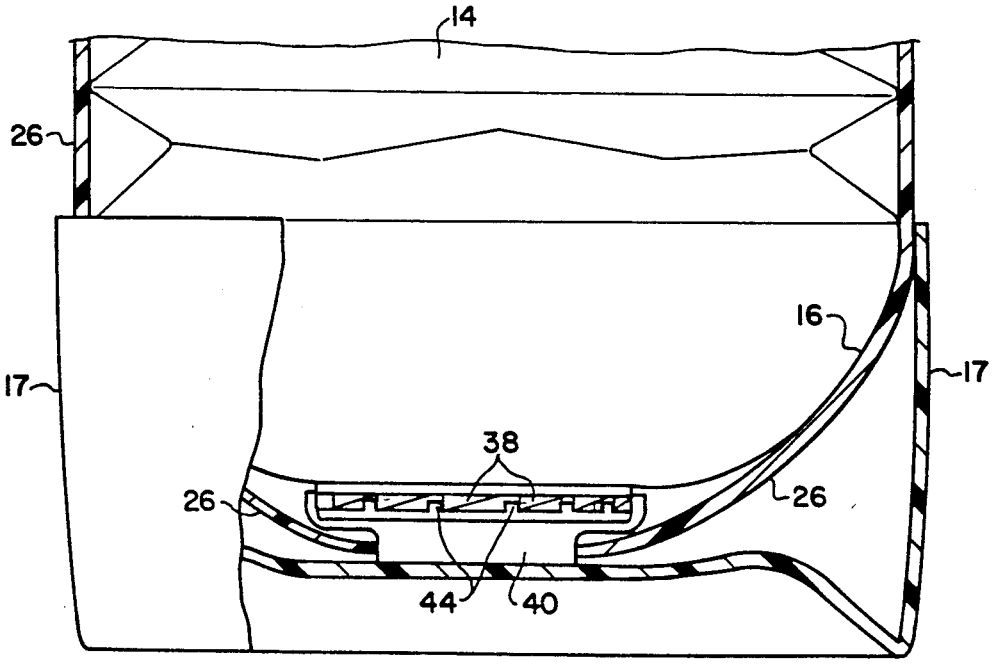
FIG. 7 is a fragmented side elevational view, partially in section, illustrating further details of the embodiment shown in FIG. 1.

Referring to FIGS. 4, 5 and 7, when the cup 17 is positioned on the bottom portion of the bottle, with the projection 36 (FIG. 4) positioned within opening 42 (FIG. 5) of the annular member 40, a portion 46 of the projection 36 serves to position the bottle relative to the cup 17. Portion 46 can be seen in FIG. 6. The lower ends of the straps 26 (FIG. 7) are secured to the annular member 40, whereby when the cup 17 is rotated relative to bottom surface 16, the ends of the strap are wound on member 40. If such relative motion occurs with pressure in the bottle relieved, the projections 44 ride up the inclined surfaces of segments 38. The combined action of the winding of the straps and the rise of the projections on the inclined segments 38 exerts a force on the collapsible central portion 14 of the bottle, causing it to compress. As the projections 44 drop into position between the segments 38, the cup is locked against reverse rotation. Thus, any tendency for the bottle to expand is prevented.

Figure 9:
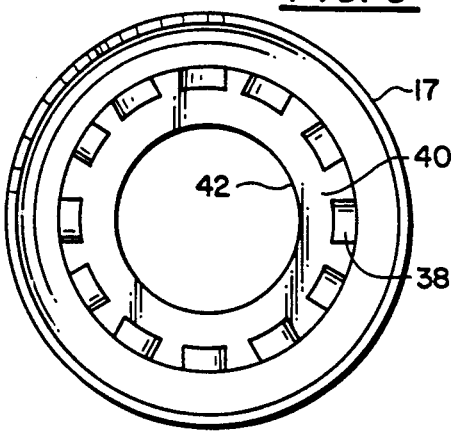
FIG. 9 is a top plan view of an alternative to the embodiment shown in FIG. 5.
Figure 8:
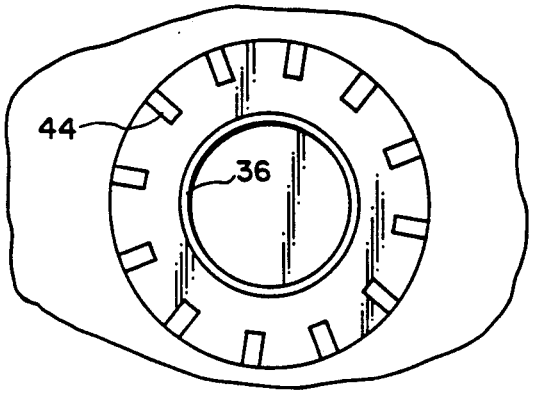
FIG. 8 is a fragmented bottom view of an alternative to the embodiment shown in FIG. 4.
Figure 11:
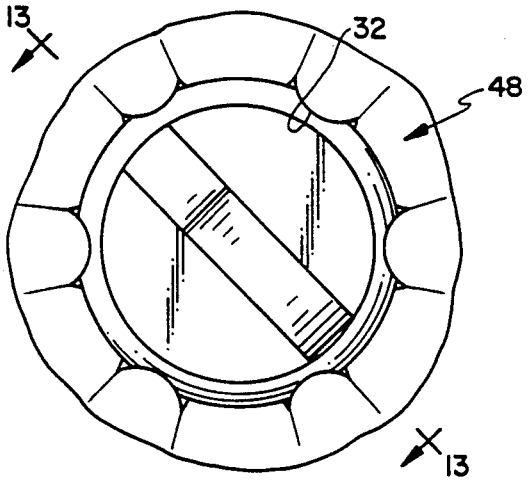
FIG. 11 is fragmented bottom view of a portion of the embodiment shown in FIG. 10.

As can be seen in FIGS. 8 and 9, the radially spaced projections 44 and the inclined segments 38 may be located on the bottom of the bottle 16 and the annular member 40, respectively.

If further compression of the bottle is desired, the cap 19 of the bottle remains loosened or removed so as to relieve pressure within the bottle. A manual rotational force on the cup 17 in the direction of the incline of segments 38 causes additional compression of the bottle. When the desired volume of air above the contents of the bottle is achieved, the cap 19 is tightened.

Figure 12:
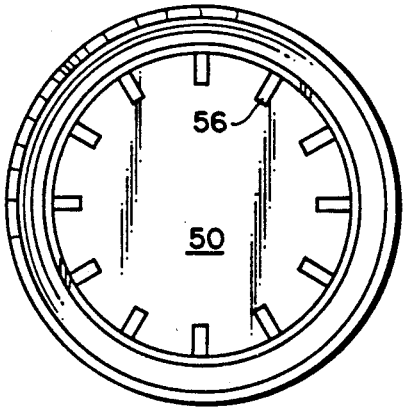
FIG. 12 is a top plan view of the winding knob portion of the embodiment shown in FIG. 10.
Figure 13:
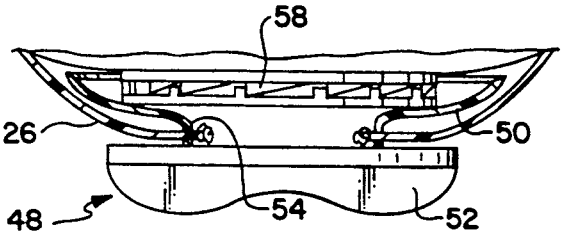
FIG. 13 is a fragmented sectional view taken along the line 13—13 of FIG. 11.
Figure 14:
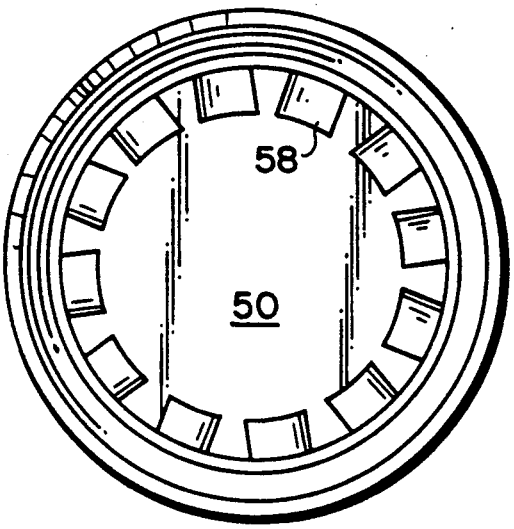
FIG. 14 is a top plan view of an alternative to the winding knob portion of the embodiment shown in FIG. 10.
Figure 15:
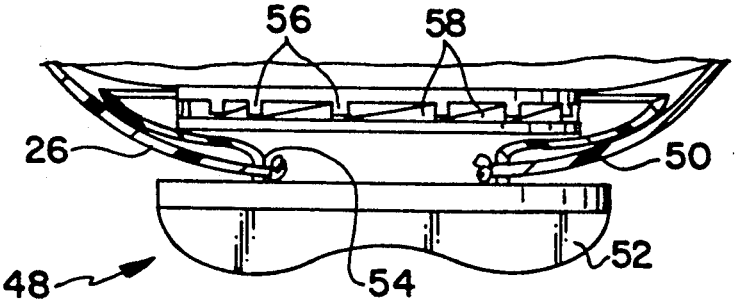
FIG. 15 is a fragmented sectional view of an alternative to the embodiment shown in FIG. 13.

The ratcheting arrangement 34 of the FIG. 10 embodiment is illustrated in FIGS. 11-15. More specifically, the lower ends of straps 26 are connected to a winding knob 48 which includes a disk portion 50 joined to a handle portion 52 by a generally cylindrical spool segment 54 (FIGS. 13 and 15). The top of the winding knob 48 includes a plurality of annular spaced projections 56 formed on the upper surface of disk 50 (FIGS. 12 and 15). The projections 56 cooperate with an annular array of inclined segments 58 (FIGS. 13 and 15) formed on the underside of the bottle 10 concentrically with the bottle's longitudinal axis. The flexible straps 26 extend along the periphery of the bottle, each strap passing between a respective pair of pedestals 32 to be secured at its lower end to the winding knob at its cylindrical portion 54. Consequently, when the handle portion 52 is turned relative to the bottom of the bottle, the straps 26 are wound around spool segment 54 and the projections 56 ride up the inclined surfaces of respective segments 58. As in the case of the FIG. 1 embodiment, when the projections pass over the peaks of the inclined segments 58, they fall into the spaces between the segments, thus locking the handle 52 against reverse rotation. As a result, the bottle is compressed in the manner previously described.

As can be seen in FIGS. 14 and 15, the annular spaced projections 56 and the inclined segments 58 can be located on the bottom of the bottle and the disk portion 50, respectively.

The embodiments which have been disclosed are readily adaptable to conventional plastic bottles. More specifically, the ratchet arrangement 28 in the FIG. 1 embodiment can be formed on the bottom of surface 16 and the interior of cup 17 as those elements are molded. Similarly, the inclined segments 58 of the FIG. 10 embodiment can be produced as the bottle is being molded. The knob portion can be fabricated in a single separate molding operation. The single-piece collar 24 and depending straps 26 also can be easily fabricated, and the lower ends of the straps can be secured to the respective ratcheting arrangements in a simple manner utilizing appropriate slots or openings (not shown) in those portions of the ratcheting arrangements to which the straps are joined.

The present invention has been disclosed with reference to two preferred embodiments which correspond to commercially available beverage bottles. However, other modifications or configurations are possible to those skilled in the art which encompass the scope and spirit of this invention. Furthermore, the present invention has been described with reference to a carbonated beverage, but nothing precludes a non-carbonated beverage from being contained in a bottle according to this invention.

What is claimed is:

1. A collapsible bottle of the type including a base portion, a top portion having a bottle neck and cap, and a pleated central body portion joining the base and top portions, the improvement comprising:

a circular collar received about the neck of said bottle;

a plurality of flexible straps extending from said collar to said base portion; and means provided at said base portion, and secured to said straps, for selectively applying force to said bottle causing the central portion to compress.

2. A collapsible bottle according to claim 1, wherein said force applying means comprises a ratcheting arrangement selectively operable to reduce the length of the straps between the collar and the base portion of the bottle.

3. A collapsible bottle according to claim 2, wherein said base portion of the bottle includes a plurality of radially spaced pedestals upon which the bottle rests when the bottle is in an upright position, said pedestals defining a recess within which said ratcheting arrangement is located, said straps extending from the collar to the ratcheting arrangement by passing between adjacent pedestals.

4. A collapsible bottle according to claim 2, wherein said ratcheting arrangement comprises:

a generally convex hemispherical surface located at the bottom of said bottle;

a cup surrounding said bottom surface of the bottle and rotatable relative thereto about a longitudinal axis of the bottle, said cup having an interior surface and an exterior surface;

an annular member located on the interior surface of the cup and centered about the longitudinal axis of the bottle;

a plurality of annular segments having inclined surfaces and arranged concentrically with respect to the longitudinal axis of the bottle and being fixed to the annular member; and a plurality of annularly arranged projections fixed on the bottom of the bottle and located concentrically with respect to the longitudinal axis of the bottle, said projections being positioned in operative relationship with said annular segments, said straps being secured to the annular member so that when the cup is rotated, the straps are wound around said annular member.

5. A collapsible bottle according to claim 2, wherein said ratcheting arrangement comprises:

a winding knob rotatable about a longitudinal axis of the bottle, said knob including an integrally formed handle portion, a cylindrical spool segment and a disk portion, said spool segment being arranged coaxially with said longitudinal axis and the disk portion being arranged in facing relationship with a bottom of the bottle;

a plurality of annular segments having inclined surfaces and arranged concentrically with the longitudinal axis of the bottle, said segments being fixed to the surface of the disk facing the bottle bottom; and a plurality of annularly arranged projections located concentrically with respect to the longitudinal axis and being fixed to the bottle bottom, said projections being positioned in operative relationship with said annular segments, said straps being secured to the ratcheting arrangement whereby when the winding knob is rotated, the straps are wound about the spool segment.

6. A collapsible bottle according to claim 2, wherein said ratcheting arrangement comprises:

a generally convex hemispherical surface located at the bottom of said bottle;

a cup surrounding said bottom surface of the bottle and rotatable relative thereto about a longitudinal axis of the bottle, said cup having an interior surface and an exterior surface;

an annular member located on the interior surface of the cup and centered about the longitudinal axis of the bottle;

a plurality of annular segments having inclined surfaces and arranged concentrically with the longitudinal axis of the bottle, said segments being fixed to the bottom surface of the bottle; and a plurality of annularly arranged projections located concentrically with respect to the longitudinal axis of the bottle and being fixed to the surface of the annular member, said projections being positioned in operative relationship with said annular segments, said straps being secured to the ratcheting arrangement whereby when the cup is rotated, the straps are wound about the annular member.

7. A collapsible bottle according to claim 6, further comprising a cylindrical projection integrally formed with the bottom surface of the bottle and positioned within a center portion of the annular member for positioning the cup with respect to the bottom of the bottle.

8. A collapsible bottle according to claim 6, wherein said annular segments and the annular projections are integrally formed with the respective bottom surface of the bottle and interior bottom surface of the cup.

9. A collapsible bottle according to claim 7, wherein said annular segments and the annular projections are integrally formed with the respective bottom surface of the bottle and interior bottom surface of the cup.

10. A collapsible bottle according to claim 7, wherein said cylindrical projection includes a lip located around a distal edge of the cylindrical portion for securing said cup to said bottom of the bottle.

11. A collapsible bottle according to claim 2, wherein said ratcheting arrangement comprises:

a winding knob rotatable about a longitudinal axis of the bottle, said knob including an integrally formed handle portion, a cylindrical spool segment and a disk portion, said spool segment being arranged coaxially with said longitudinal axis and the disk portion being arranged in facing relationship with a bottom of the bottle;

a plurality of annular segments having inclined surfaces and arranged concentrically with the longitudinal axis of the bottle, said segments being fixed to the bottom of the bottle; and a plurality of annularly arranged projections located concentrically with respect to the longitudinal axis and being fixed to the disk surface, said projections being positioned in operative relationship with said annular segments, said straps being secured to the ratcheting arrangement whereby when the winding knob is rotated, the straps are wound about the spool segment.

12. A collapsible bottle according to claim 11, wherein said annular segments and the annular projections are integrally formed with the respective bottle bottom and disk surface.

13. A collapsible bottle according to claim 11, wherein said base portion of the bottle includes a plurality of radially spaced pedestals upon which the bottle rests when the bottle is in an upright position, said pedestals defining a recess within which said ratcheting arrangement is-located, said straps extending from the collar to the ratcheting arrangement by passing between adjacent pedestals.

14. A collapsible bottle according to claim 1 wherein the central body portion is pleated along fold lines spaced substantially equally along its length, adjacent fold lines being arranged so that they alternately fold inwardly toward a longitudinal axis of said bottle and outwardly away from said axis, the inwardly folding fold lines having a wall thickness less than a wall thickness of said outwardly folding fold lines.

15. A collapsible bottle according to claim 14, wherein said outwardly folding fold lines lie in parallel planes normal to the longitudinal axis of the bottle and wherein the inwardly folding fold lines are deformed at radially spaced intervals in alternately opposite sense relative to the direction of the longitudinal axis of the bottle.

16. A collapsible bottle of the type including a base portion, a top portion, and a pleated central body portion joining the base and top portions, wherein the central body portion is pleated along fold lines spaced substantially equally along the length, adjacent fold lines being arranged so that they alternately fold inwardly toward a longitudinal axis of said bottle and outwardly away from said axis, the inwardly folding fold lines having a wall thickness less than a wall thickness of said outwardly folding fold lines and deformed at radially spaced intervals in alternately opposite sense relative to the direction of the longitudinal axis of the bottle, the outwardly folding fold lines located in parallel planes normal to the longitudinal axis of the bottle.

* * * * *